US007871069B2

(12) United States Patent
Lee et al.

(10) Patent No.: US 7,871,069 B2
(45) Date of Patent: Jan. 18, 2011

(54) SHEET ROLLER

(75) Inventors: Dong Sik Lee, Seoul (KR); Won Joon Lee, Seoul (KR); Joon Hyuk Han, Seoul (KR)

(73) Assignee: Nautilus Hyosung Inc., Seoul (KR)

( * ) Notice: Subject to any disclaimer, the term of this patent is extended or adjusted under 35 U.S.C. 154(b) by 630 days.

(21) Appl. No.: 11/771,302

(22) Filed: Jun. 29, 2007

(65) Prior Publication Data

US 2008/0001351 A1 Jan. 3, 2008

(30) Foreign Application Priority Data

Jun. 30, 2006 (KR) ..... 10-2006-0061093

(51) Int. Cl.
*B65H 29/40* (2006.01)
*B65H 29/20* (2006.01)

(52) U.S. Cl. ..... 271/178; 271/314; 271/306; 271/187; 271/3.08

(58) Field of Classification Search ..... 271/306, 271/187, 178, 314, 3.08
See application file for complete search history.

(56) References Cited

U.S. PATENT DOCUMENTS 3,166,313 A * 1/1965 Rehm ..... 271/178
7,243,914 B2 * 7/2007 Tokunaga et al. ..... 271/3.01
7,513,498 B2 * 4/2009 Elenes et al. ..... 271/178
7,591,468 B2 * 9/2009 Ryan et al. ..... 271/306
2008/0001352 A1 * 1/2008 Jeong ..... 271/306

FOREIGN PATENT DOCUMENTS

JP 03227873 A * 10/1991

* cited by examiner

*Primary Examiner*—Stefanos Karmis
*Assistant Examiner*—Luis Gonzalez
(74) *Attorney, Agent, or Firm*—Fish & Richardson P.C.

(57) ABSTRACT

Disclosed is a sheet roller capable of achieving compactness and thinness, and improves space usability and design freedom. The sheet roller includes a roller body coupled with the rotation shaft, a plurality of coupling members coupled with a side surface of the roller body in order to surround a part of an outer peripheral surface of the roller body, and disposed on the outer peripheral surface of the roller body in such a manner as to be spaced apart from one another, and an elastic sheet interposed between the roller body and each of the plurality of coupling members. The roller body is formed to have a predetermined thickness thereof while maintaining a predetermined shape and strength thereof, and thus, improving space usability and the design freedom of an automatic transaction machine where the sheet roller is mounted.

8 Claims, 11 Drawing Sheets

SHEET ROLLER

CROSS-REFERENCE TO RELATED APPLICATION

This application claims the benefit of Korean Patent Application No. 10-2006-0061093, filed on Jun. 30, 2006, in the Korean Intellectual Property Office, the entire disclosure of which is incorporated herein by reference.

BACKGROUND OF THE INVENTION

1. Field of the Invention

The present invention relates to a sheet roller mounted to an automatic transaction machine, and more particularly, to a sheet roller which achieves compactness and thinness, and improves space usability and design freedom.

2. Description of Related Art

In general, an automatic transaction machine provides basic financial services such as a money reception/dispensing without a bank teller regardless of time and location. The automatic transaction machine is classified into a cash dispensing machine and a cash depositing/dispensing machine depending on money reception/dispensing. Recently, the automatic transaction machine has been used for multiple purposes such as a check reception/dispensing, bank book update, Giro payment, ticket dispensing, and the like, in addition to the money reception/dispensing.

Recently, the automatic transaction machine is widely used in a bank, a financial organization, and the like, and customers frequently use the automatic transaction machine due to convenience of use. In this regard, transaction amounts have been accordingly increased due to an increase of the types of uses of the automatic transaction machine. A large amount of cash is deposited and dispensed according to the increase in transaction amounts, and accordingly, undesirable problems are caused in the automatic transaction machine due to mutual movement and interference in positioning of the large amount of cash.

Cash in the automatic transaction machine is transferred for each cash unit, and the transferred cash is gathered and arranged in a money dispensing part of the automatic transaction machine to be dispensed to a user.

FIG. 1 is a side view illustrating a money dispensing part 10 of a conventional automatic transaction machine, and FIG. 2 is a perspective view illustrating a conventional sheet roller.

As illustrated in FIGS. 1 and 2, the money dispensing part 10 is positioned at an outlet end of a transfer device 20, and cash discharged from the transfer device 20 are loaded on the money dispensing part 10. After a predetermined amount of cash is discharged into the money dispensing part 10, a shutter of the money dispensing part 10 (not shown) is opened so that a user can receive the cash provided for a stack unit.

The transfer device 20 includes an upper transfer section 30 defining an upper boundary of a transferring route where the cash is transferred, and a lower transfer section 40 defining a lower boundary thereof. The upper and the lower sections 30 and 40 include transfer belts 31 and 41 transferring cash while being revolved along a predetermined transfer route, transfer rollers 32 and 42 defining each transfer trace of the transfer belts 31 and 41, and rotation shafts 33 and 43 supporting the transfer rollers 32 and 42 so as to be rotated, respectively.

A sheet roller 50 is rotatably mounted adjacent to the outlet end of the transfer device 20 in order to support a bottom surface of cash discharged via the transfer device 20 and guides the cash to the money dispensing part 10. The sheet roller 50 includes a roller body 51, and a plurality of elastic sheets 53 radially formed on a circumferential surface of the roller body 51. The sheet roller 50 may be rotated between respective transfer roller 32 and 42 of the upper and the lower transfer sections 30 and 40 about a rotation shaft 43 of the lower transfer section 40 adjacent to the outlet end of the transfer device 20. In this manner, the bottom surface of the cash discharged from the transfer device 20 is supported and guided to the money dispensing part 10 by the plurality of elastic sheets 53 of the rotating sheet roller 50.

Also, each elastic sheet 53 of the sheet roller 50 is coupled with the roller body 51 by a coupling piece 52 slidingly coupled with the roller body 51. In this regard, the roller body 51 includes a plurality of coupling grooves 51*a* formed along a circumferential surface of the roller body 51 and formed into a shape to conform to that of the coupling piece 52, so that the coupling piece 52 is slidingly inserted into the corresponding coupling groove 51*a* in the axial direction of the rotation shaft 43. Each elastic sheet 53 is partially disposed between the coupling piece 52 and the coupling groove 51*a* so as to be mounted to the roller body 51, and selectively separated from the roller body 51 together with the coupling piece 52.

However, the conventional sheet roller 50 described above has a problem in that it has a limitation in reducing thickness of the roller sheet while maintaining a predetermined shape and strength thereof. Specifically, the conventional sheet roller 50 is required to be formed to have a predetermined thickness T1 in order to permit the roller body 51 of the sheet roller 50 to have a predetermined shape and strength thereof. Also, the roller body 51 is required to ensure a predetermined thickness T2 in order to permit the coupling groove 51*a* to be formed on the roller body 51 to be slidingly coupled with the coupling piece 52. As a result, there occurs a problem in that a thickness of the roller body 51 is inevitably increased by a depth of the coupling groove 51*a*.

Also, the automatic transaction machine is required to ensure a predetermined space where the sheet roller 50, which must be formed to have a relatively greater thickness than a predetermined thickness, is mounted, and thus, deteriorating space usability and design freedom. In addition, the sheet roller 50 suffers from interference by peripheral components adjacent to the sheet roller 50.

Further, the conventional sheet roller 50 has a problem in that the elastic sheet 53, having different thicknesses depending on mounting position, design configuration, and the like, is difficult to be mounted to the sheet roller 50. Specifically, since a gap is formed between the coupling groove 51*a* and the coupling piece 52 in order to allow only the elastic sheet having a predetermined thickness to be interposed between the coupling groove 51*a* and the coupling piece 52, when a relatively thicker elastic sheet is used, the coupling piece 52 fails to be coupled with the coupling groove 51*a*. As a result, when an elastic sheet having a different thickness from the predetermined thickness of the elastic sheet 53 is mounted to the roller body 51, a separate roller body and coupling piece are required to be fabricated to correspond to the different thickness.

In addition, the conventional sheet roller 50 has a problem in that, in terms of structural properties, the sheet roller 50 has to be mounted to the rotation shaft 43 in accordance with the order of assembly with components such as the transfer roller, and the like, before the rotation shaft 43 is mounted, and thus deteriorating productivity and workability thereof.

That is, when the sheet roller 50 is pre-assembled or post-assembled in a different order of assembly from the standard order of assembly due to carelessness of a worker, various components having been previously mounted to the rotation shaft 43 are required to be separated/disassembled and then the sheet roller 50 is again required to be mounted.

Also, there occurs an inconvenience in that, in order to replace the sheet roller 50, first, the rotation shaft 43 where the sheet roller 50 is mounted is separated/disassembled from a place where the rotation shaft 43 has been mounted, second, various components mounted to the rotation shaft 43 are separated from the rotation shaft 43, and finally, the sheet roller 50 is replaced.

SUMMARY OF THE INVENTION

An aspect of the present invention provides a sheet roller capable of achieving compactness and thinness thereof.

Another aspect of the present invention provides a sheet roller capable of improving space usability and design freedom of an automatic transaction machine where the sheet roller is mounted.

Still another aspect of the present invention provides a sheet roller capable of improving productivity and workability thereof and readily being mounted in an appropriate position regardless of an order of assembly with other components.

Yet another aspect of the present invention provides a sheet roller capable of facilitating maintenance and repair thereof without separation/disassembly of other components.

According to an aspect of the present invention, there is provided a sheet roller including a roller body coupled with the rotation shaft; a plurality of coupling members coupled with a side surface of the roller body in order to surround a part of an outer peripheral surface of the roller body, and disposed on the outer peripheral surface of the roller body in such a manner as to be spaced apart from one another; and an elastic sheet interposed between the roller body and each of the plurality of coupling members.

In this instance, each of the plurality of coupling members is formed in a U-shape-like, and includes a cover portion formed to surround a part of the outer peripheral surface of the roller body, and a pair of coupling pieces integrally formed on both ends of the cover portion and coupled with the side surface of the roller body.

In this instance, each of the pair of coupling pieces is formed on the cover portion in order to be elastically coupled with the roller body, and includes a coupling protrusion formed on an inner surface of the coupling piece, wherein the roller body includes a fastening step formed on the side surface of the roller body for allowing the coupling protrusion to be fastened to the fastening step. The coupling piece may surround a part of the side surface of the roller body and be coupled with the circumferential surface of the roller body by a typical coupling element such as a screw, a pin, and the like, if necessary.

In this instance, the roller body includes a plurality of receiving grooves formed on the roller body for allowing the elastic sheet and the coupling member to be received on the receiving groove. The coupling member may directly surround the part of the circumferential surface of the roller body in the state where the receiving groove is excluded.

In this instance, a middle portion of the elastic sheet is fixed to the roller body together with the coupling member, and both free ends of the elastic sheet are radially disposed about the roller body. The elastic sheet includes a sheet extension portion supported between the pair of coupling pieces, and the sheet extension portion is extendedly formed to have a width corresponding to an interval between the pair of the coupling pieces. Also, the coupling member includes a sheet fixing protrusion formed on the coupling member, and the elastic sheet includes a sheet fixing hole formed on the elastic sheet for allowing the sheet fixing protrusion to be fixed and inserted into the sheet fixing hole.

According to another aspect of the present invention, there is provided a sheet roller including a first roller body coupled with the rotation shaft; a second roller body mutually assembled with the first roller body interposing the rotation shaft; a plurality of coupling members coupled with respective side surfaces of the first and the second roller bodies in order to surround a part of respective outer peripheral surfaces of the first and the second roller bodies, and disposed on the respective outer peripheral surfaces of the first and the second roller bodies in such a manner as to be spaced apart from one another; and an elastic sheet interposed between the respective roller bodies and each of the plurality of coupling members.

When necessary, the sheet roller may include at least three roller bodies, and the respective roller bodies may be formed in a predetermined circular arc and then assembled to be formed in a ring shape as a whole, so that respective ends of the respective roller bodies are successively connected with one another.

In this instance, the first roller body includes a first latching piece formed on the first roller body, the first latching piece having a first latching protrusion, and the second roller body includes a second latching piece formed on the second roller body, the second latching piece having a second latching protrusion, wherein the first and the second latching protrusions are elastically coupled with each other. The first and the second roller bodies are formed identical with each other in such a manner that the first and the second latching protrusions are disposed to be oriented toward the same direction, and the first and the second latching protrusions are coupled to be opposed to each other. The first and the second roller bodies may be separately formed to have different shapes from each other as necessary.

Also, depending upon embodiments, a sliding protrusion may be formed on any one of opposite surfaces of the first and the second roller bodies, and a sliding protrusion may be formed another one of the opposite surfaces of the first and the second roller bodies so that the first and the second roller bodies are slidingly assembled along the axial direction of the rotation shaft of the sheet roller.

In this instance, a separation prevention protrusion is formed on a surface of mutual contact surfaces of the first and the second roller bodies, and a separation prevention groove is formed on another surface of mutual contact surfaces of the first and the second roller bodies, the separation prevention protrusion being received on the separation prevention groove.

In this instance, a rotation restriction protrusion is formed on at least an inner peripheral surface of the first and the second roller bodies, and a rotation restriction groove is formed on an outer peripheral surface of the rotation shaft, the rotation restriction groove receiving the rotation restriction protrusion. depending upon embodiments, a coupling hole having a non-circular shaped-rotation restriction surface may be formed on the inner peripheral surface of the sheet roller so as to correspond to a rotation restriction surface of the rotation shaft so that the relative rotation of the sheet roller to the rotation shaft is prevented.

The paper medium denotes a sheet shaped-item having a predetermined value such as a paper, a check, a ticket, and the like, and is made of paper material, however, may be made of a material being capable of being substituted for the paper material such as a plastic thin film.

According to the present invention, an example where the sheet roller is mounted to the outlet end of the transfer device for transferring a paper medium to the money dispensing part of the automatic transaction machine is described here, however, depending upon embodiments, the sheet roller of the present invention may be mounted to a position where another stack is required inside the automatic transaction machine other than the money dispensing part. As an example, in the automatic transaction machine, the sheet roller of the present invention may be mounted to an outlet end of a transfer device for transferring a paper medium to a temporary stack part for temporarily stacking the paper medium.

BRIEF DESCRIPTION OF THE DRAWINGS

The above and other aspects of the present invention will become apparent and more readily appreciated from the following detailed description of certain exemplary embodiments of the invention, taken in conjunction with the accompanying drawings of which.

DETAILED DESCRIPTION OF EXEMPLARY EMBODIMENTS

Figure 1:
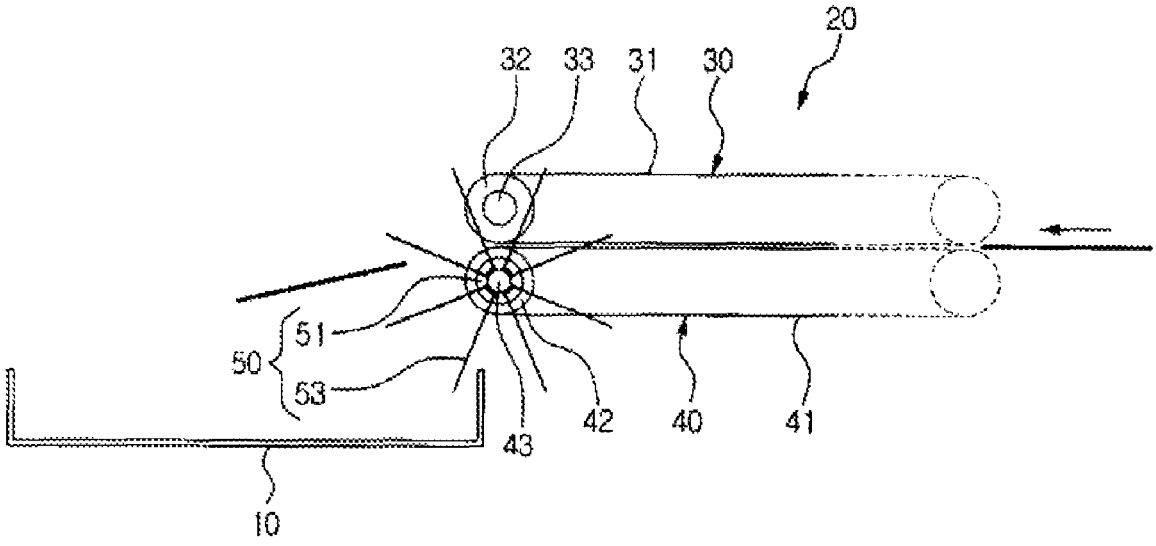
FIG. 1 (CONVENTIONAL ART)
FIG. 1 is a side view illustrating a money dispensing part of a conventional automatic transaction machine.

Reference will now be made in detail to exemplary embodiments of the present invention, examples of which are illustrated in the accompanying drawings, wherein like reference numerals refer to the like elements throughout. The exemplary embodiments are described below in order to explain the present invention by referring to the figures.

Figure 3:
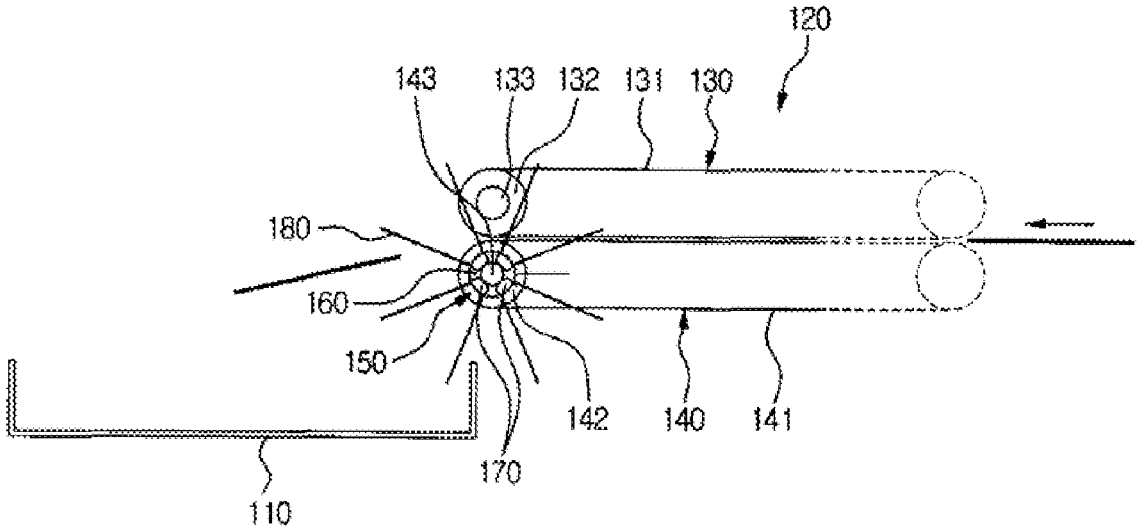
FIG. 3 is a side view illustrating a structure of an automatic transaction machine where a sheet roller according to an exemplary embodiment of the present invention is mounted.
Figure 4:
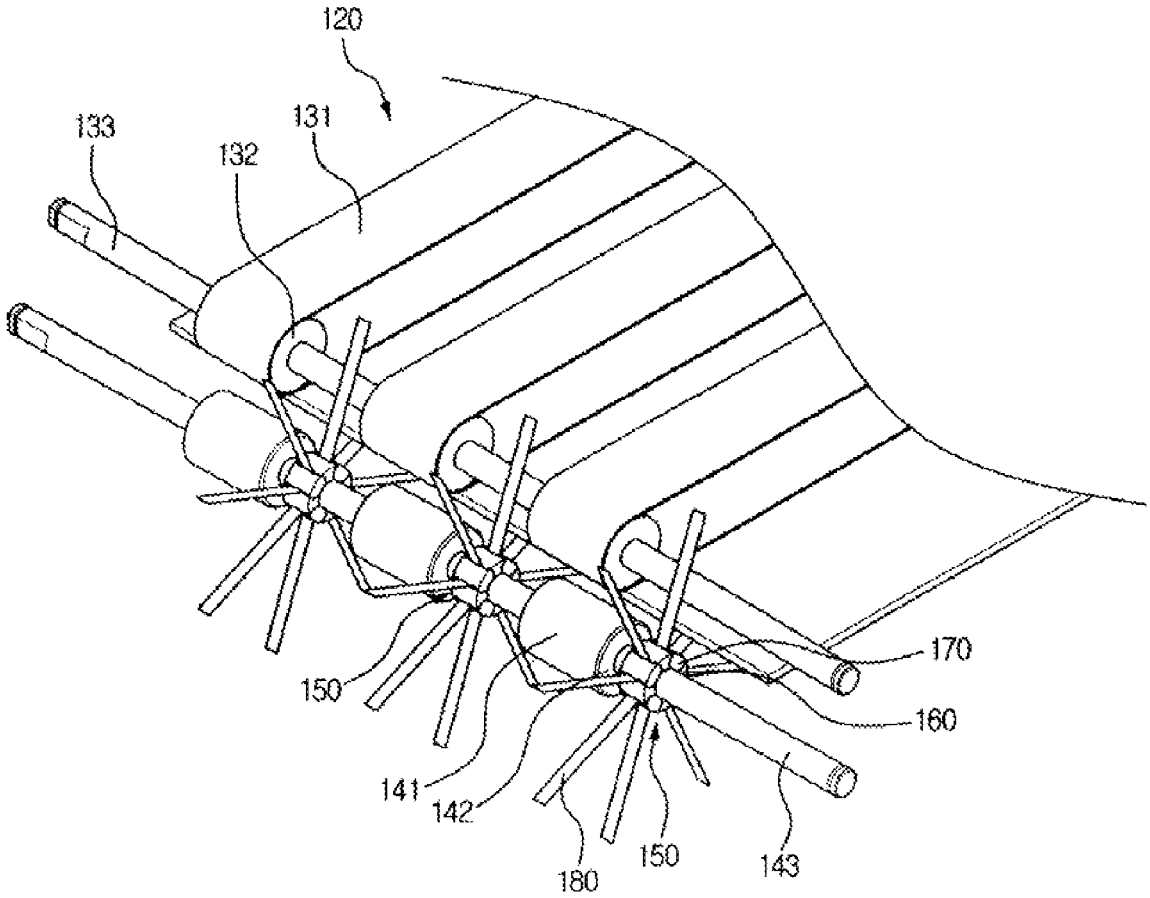
FIG. 4 is a perspective view illustrating a state where a sheet roller according to an exemplary embodiment of the present invention is mounted.

FIG. 3 is a side view illustrating a structure of an automatic transaction machine where a sheet roller according to an exemplary embodiment of the present invention is mounted, and FIG. 4 is a perspective view illustrating a state where a sheet roller according to an exemplary embodiment of the present invention is mounted.

As illustrated in FIGS. 3 and 4, an automatic transaction machine where a sheet roller according to the present exemplary embodiment of the invention includes a transfer device 120 transferring a paper medium such as a cash from a storage part such as a cash cassette, a money dispensing part 110 mounted adjacent to an outlet end of the transfer device 120 and adapted to allow the paper medium discharged from the transfer device 120 to be loaded thereon, and a sheet roller 150 mounted adjacent to the outlet end of the transfer device 120 and adapted to allow a bottom surface of the paper medium discharged from the transfer device 120 to be supported and guided to the money dispensing part 110.

In this manner, the paper medium of the storage part is transferred via the transfer device 120 and the discharged paper medium from the transfer device 120 may be loaded on the money dispensing part 110. When a predetermined amount of the paper medium is transferred to the money dispensing part 110, a shutter of the money dispensing part 110 may be opened, so that a user may receive the paper medium provided for a stack unit.

The transfer device 120 includes an upper transfer section 130 defining an upper boundary of a transferring route where the paper medium is transferred, and a lower transfer section 140 defining a lower boundary thereof.

The upper transfer section 130 includes an upper transfer belt 131 defining the upper boundary of the transferring route while being revolved along a predetermined transfer route, an upper transfer roller 132 defining a transfer trace of the upper transfer belt 131, and a rotation shaft 133 supporting the upper transfer roller 132 to be rotated. The lower transfer section 140 includes a lower transfer belt 141 defining the lower boundary of the transferring route while being revolved along a predetermined transfer route, a lower transfer roller 142 defining a transfer trace of the lower transfer belt 141, and a rotation shaft 143 supporting the lower transfer roller 142 to be rotated. Each of the upper and the lower transfer belts 131 and 141 of the upper and the lower transfer sections 130 and 140 is revolved, respectively, while the upper and the lower transfer rollers 132 and 142 are being rotated, respectively, so that the paper medium is transferred between the transfer belts 131 and 141.

According to the present exemplary embodiment of the invention, an example where the transferring route of the paper medium is configured to be defined by the transfer belts 131 and 141 is described here, however, the transferring route of the paper medium may be defined by a guide plate instead of the transfer belts 131 and 141 as necessary. Also, each of the respective transfer sections 130 and 140 may include another roller in addition to the transfer rollers 132 and 142 defining the respective transfer trace of the transfer belts 131 and 141, and types and positions of the transfer rollers 132 and 142 may vary depending on required conditions.

The sheet roller 150 is mounted adjacent to the outlet end of the transfer device 120, is operated in accordance with operation of the transfer device 120, and supports the bottom surface of the paper medium discharged from the transfer device 120 and guides the paper medium to the money dispensing part 110.

Figure 5:
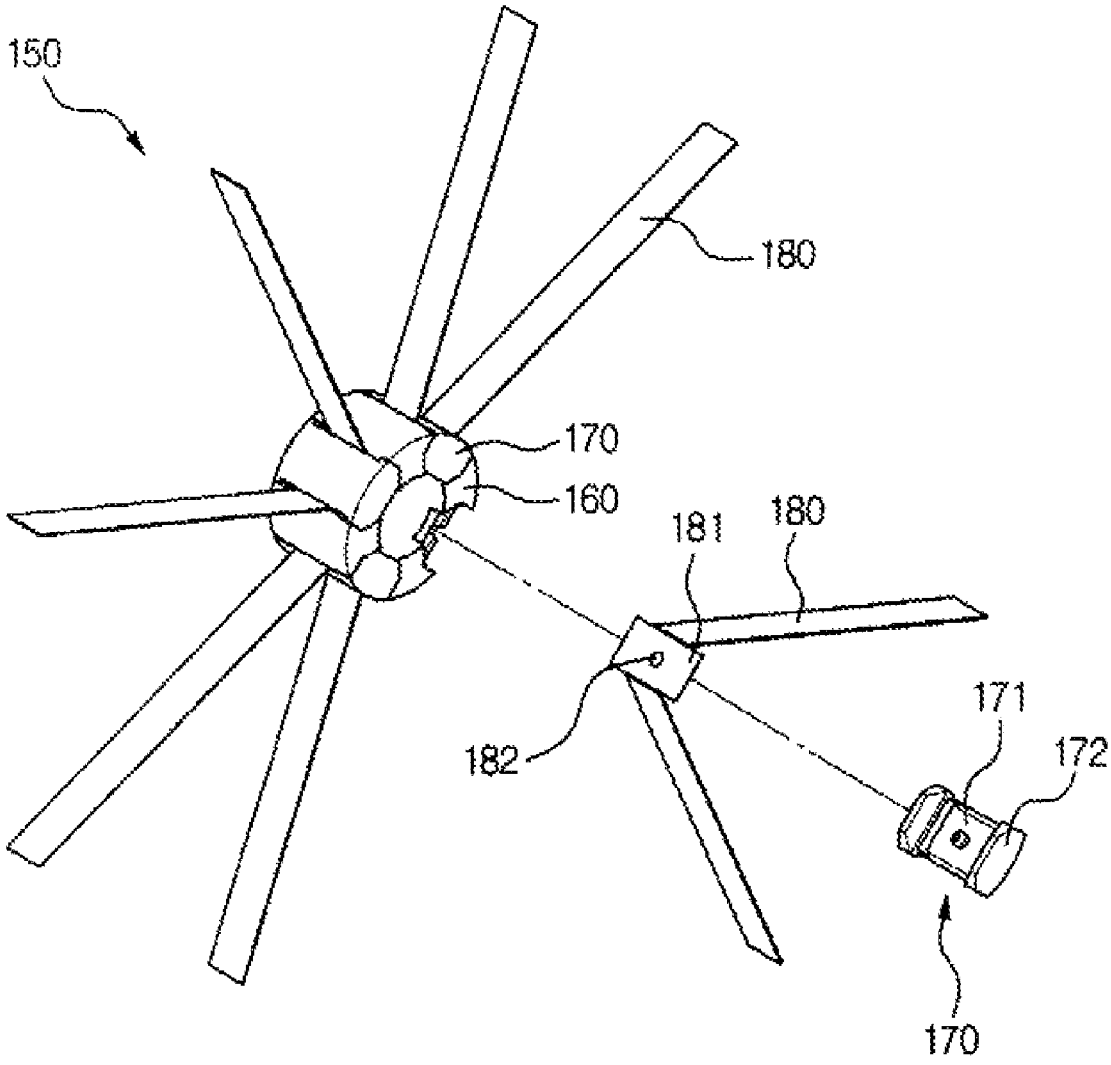
FIG. 5 is a perspective view illustrating a structure of a sheet roller according to an exemplary embodiment of the present invention.
Figure 6:
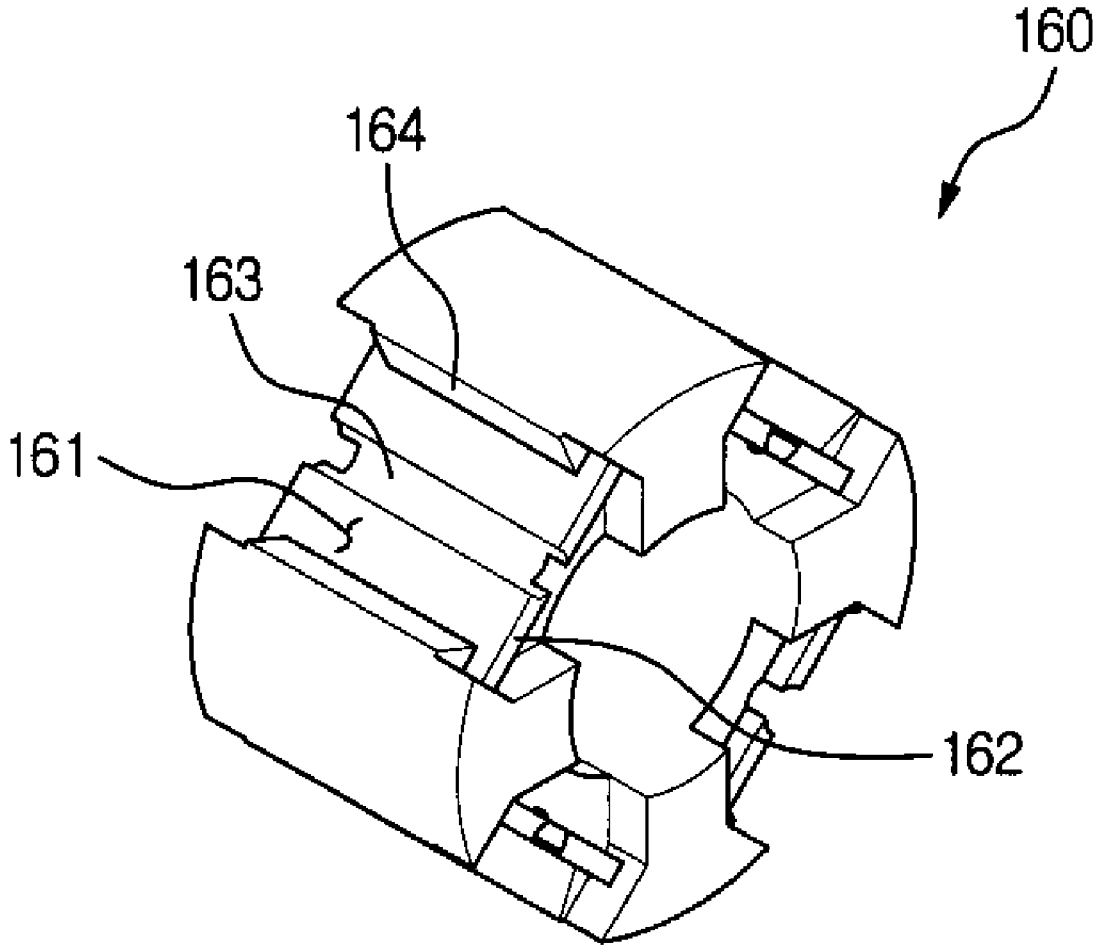
FIGS. 6 and 7 are a perspective view and a side view, respectively, illustrating a structure of a roller body in a sheet roller according to an exemplary embodiment of the present invention.
Figure 7:
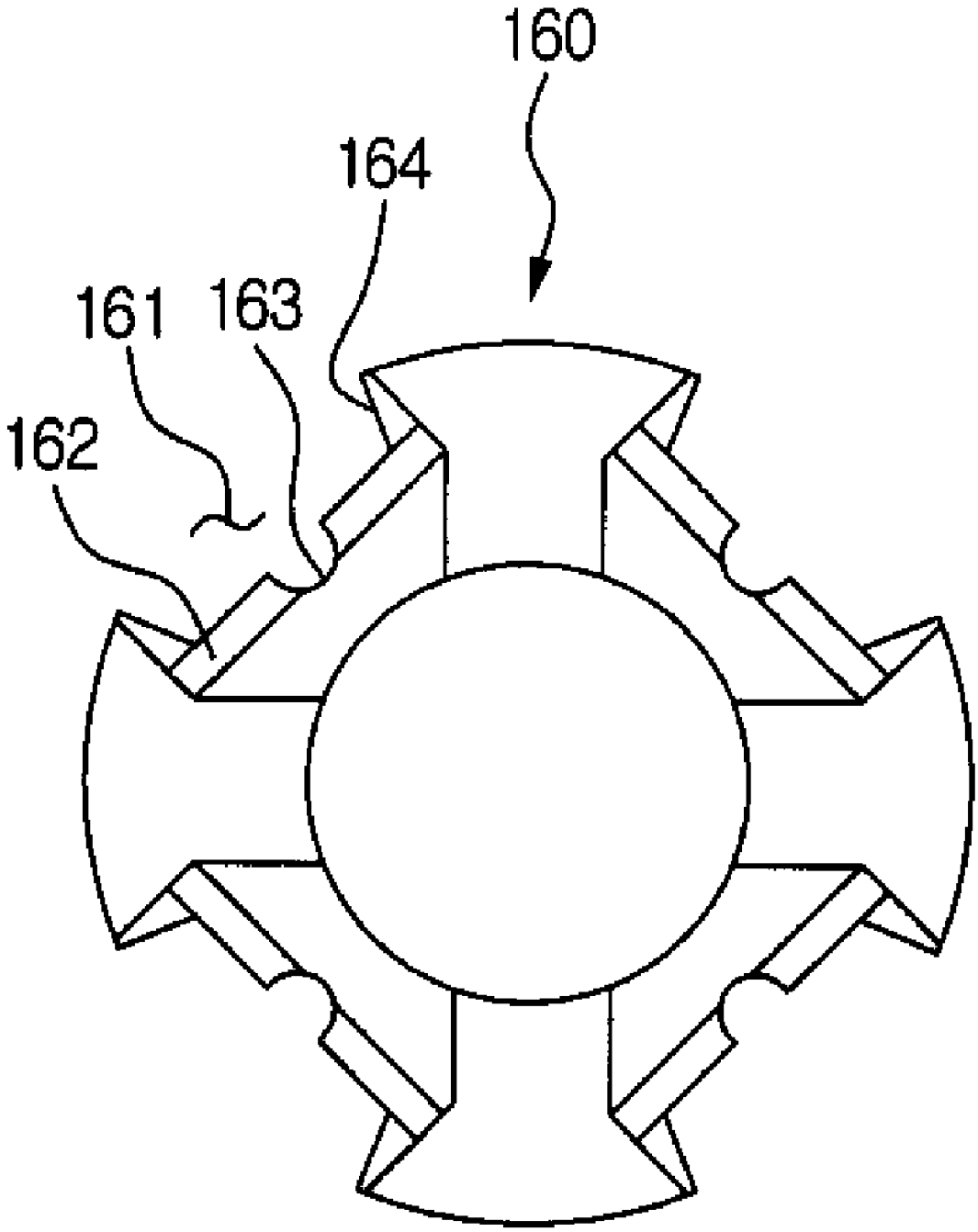
Figure 8:
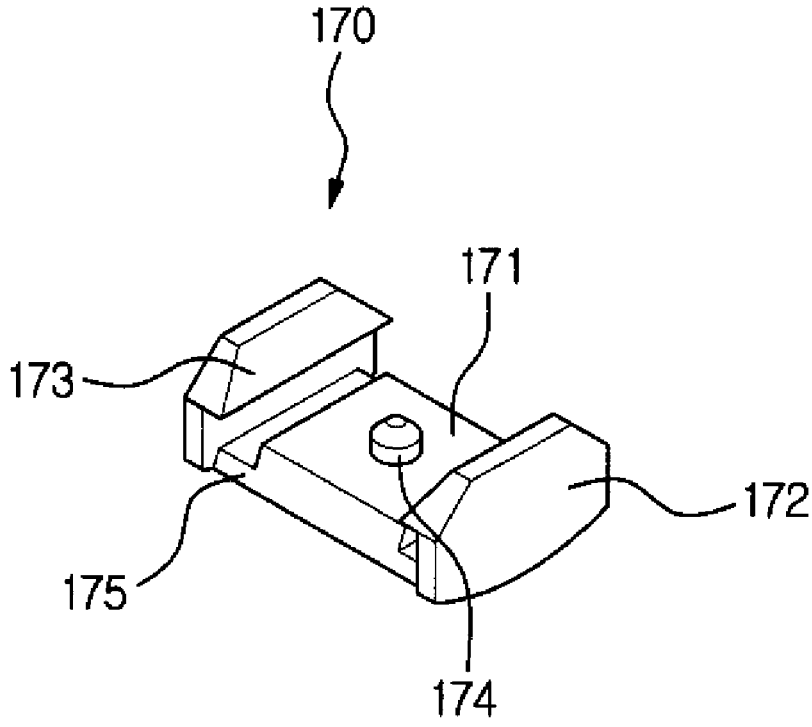
FIGS. 8 and 9 are a perspective view and a side view, respectively, illustrating a structure of a coupling member in a sheet roller according to an exemplary embodiment of the present invention.
Figure 9:
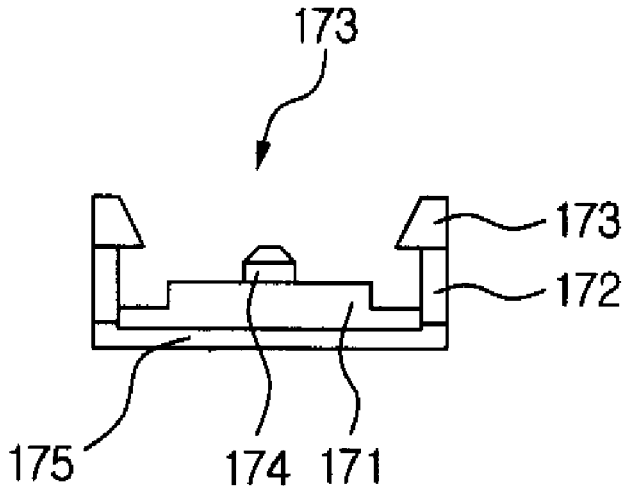

FIG. 5 is a perspective view illustrating a structure of a sheet roller according to an exemplary embodiment of the invention, FIGS. 6 and 7 are a perspective view and a side view, respectively, illustrating a structure of a roller body in a sheet roller according to an exemplary embodiment of the invention, and FIGS. 8 and 9 are a perspective view and a side view, respectively, illustrating a structure of a coupling member in a sheet roller according to an exemplary embodiment of the invention.

As illustrated in FIGS. 5 through 9, the sheet roller 150 includes a roller body 160 coupled with the rotation shaft 143;

a plurality of coupling members 170 is coupled with a side surface of the roller body 160 in order to surround a part of an outer peripheral surface of the roller body 160, and is disposed on the outer peripheral surface of the roller body in such a manner as to be spaced apart from one another; and an elastic sheet 180 is interposed between the roller body 160 and each of the plurality of coupling members 170.

The roller body 160 is formed in a ring shape, and mounted to the rotation shaft 143 of the lower transfer section 140 adjacent to the outlet end of the transfer device 120. The roller body 160 includes a plurality of receiving grooves 161 formed on an outer circumferential surface of the roller body 160 and adapted to allow the elastic sheet 180 and the coupling member 170 to be received thereon. The plurality of receiving grooves 161 are disposed along a circumferential direction of the roller body 160 in such a manner as to be spaced apart from one another.

The coupling member 170 is formed in a U-shape like and includes a cover portion 171 formed to surround a part of the outer circumferential surface of the roller body 160 and received on the receiving groove 161, and a pair of coupling pieces 172 integrally formed on both ends of the cover portion 171 and coupled with the side surface of the roller body 160. In this instance, the pair of coupling pieces 172 is formed on the cover portion 171 in order to be elastically coupled with the roller body 160. The coupling piece 172 may surround a part of the side surface of the roller body 160 and be coupled with the circumferential surface of the roller body 160 by a typical coupling element such as a screw, a pin, and the like, as necessary.

Hereinafter, an example where the coupling piece 172 is integrally and elastically formed with the cover portion 171 in order to be elastically coupled with the circumferential surface of the roller body 160 will be described. For this purpose, the coupling piece 172 includes a coupling protrusion 173 formed on an inner surface of an end portion of the coupling piece 172, and the roller body 160 includes a fastening step 162 formed on the side surface of the roller body 160 for allowing the coupling protrusion 173 to be fastened to the fastening step 162. In this manner, the coupling member 170 and the roller body 160 are mutually restricted by the coupling protrusion 173 and the fastening step 162 coupled together to be opposed to each other, so that the coupling member 170 and the roller body 160 are prevented from being separated from each other along a radial direction of the roller body 160.

The elastic sheet 180 is interposed between the coupling member 170 and the receiving groove 161, and radially disposed on the outer circumferential surface of the roller body 160 in the circumferential direction of the roller body 160 in such a manner as to be spaced apart from one another by a predetermined interval. Specifically, a middle portion of the elastic sheet 180 is interposed and fixed between the coupling member 170 and the roller body 160, and the elastic sheet 180 is divided into two elastic sheets 180 by the coupling member 170 with a predetermined length and both free ends of the elastic sheet 180 are disposed in such a manner as to be radially and outwardly extended from the roller body 160 in different directions from each other.

The elastic sheet 180 described above abuts against the paper medium in such a manner as to be elastically transformed while the sheet roller 150 is being rotated, and is preferably made of a material having a minimum predetermined friction coefficient in order to draw the paper medium. As an example, the elastic sheet 180 may be made of synthetic resin such as polyamide, and the like.

In addition, the elastic sheet 180 may include a sheet extension portion 181 formed on the elastic sheet 180, so that the elastic sheet 180 can be stably disposed on the coupling member 170 without moving. Specifically, the sheet extension portion 181 is integrally extended from side surface of the elastic sheet 180 so as to have a width corresponding to an interval between the pair of the coupling pieces 172 and supported by the pair of coupling pieces 172, so that the elastic sheet 180 can be stably disposed on the coupling member 170. Accordingly, when the elastic sheet 180 and the coupling member 170 are coupled with the roller body 160, the elastic sheet 180 is coupled with the roller body 160 together with the coupling member 170 in a state where the elastic sheet 180 is disposed on the coupling member 170.

Also, the coupling member 170 includes a sheet fixing protrusion 174 formed on an inner surface of the cover portion 171 of the coupling member 170, and the elastic sheet 180 includes a sheet fixing hole 182 formed to correspond to the sheet fixing protrusion 174, so that the sheet fixing protrusion 174 is inserted into the sheet fixing hole 182. The sheet fixing protrusion 174 and the sheet fixing hole 182 described above function to allow the elastic sheet 180 to be fixed and disposed between the roller body 160 and the coupling member 170.

Further, the roller body 160 may include a protrusion receiving groove 163 formed on a bottom surface of the receiving groove 161 formed on the roller body 160 so that at least a part of the sheet fixing protrusion 174 can be received on the protrusion receiving groove 163. As a result, the sheet fixing protrusion 174 passing through the elastic sheet 180 is selectively received on the protrusion receiving groove 163 according to a thickness of the elastic sheet 180. Specifically, in a configuration as described above, when a relatively thin elastic sheet is used, the sheet fixing protrusion 174 passes through the sheet fixing hole 182 and is received on the protrusion receiving groove 163, and conversely, when a relatively thick elastic sheet is used, the sheet fixing protrusion 174 is merely received on an inside of the sheet fixing hole 182, so that the elastic sheet 180 can be stably contacted closely to and supported by the receiving groove 161 and the coupling member 170 regardless of the thickness of the elastic sheet 180.

The elastic sheet 180 is divided into two elastic sheets with a predetermined length by the coupling member 170. The roller body 160 and the coupling member 170 include first and second inclined guide surfaces 164 and 175 formed on the roller body 160 and the coupling member 170, respectively, in such a manner as to be opposed to each other, so that the both free ends of the elastic sheet 180 are disposed inclined at a predetermined angle with each other. Specifically, the first and the second inclined guide surfaces 164 and 175 having their gradients corresponding to each other are formed on both side surfaces of the cover portion 171 and both side surfaces of the receiving groove 161 corresponding to the both side surfaces of the cover portion 171, respectively, along the axial direction of the rotation shaft 143. The elastic sheet 180 is guided by the first and the second inclined guide surfaces 164 and 175 and the both free ends of the elastic sheet 180 are extendedly disposed inclined at a predetermined angle. In this instance, an angle between the both free ends of the elastic sheet 180 may vary according to a required condition and design specification, and the angle may be adjusted by modifying gradients of the first and the second inclined guide surfaces 164 and 175.

Also, according to the present exemplary embodiment of the invention, an example where the cover portion 171 of the coupling member 170 surrounds a part of the circumferential surface of the roller body 160 in the state of being received on the receiving groove 161 is described here, depending upon embodiments, the coupling member 170 may directly surround the part of the circumferential surface of the roller body 160 in the state where the receiving groove 161 is excluded as necessary.

According to the present exemplary embodiment of the invention described above, the elastic sheet 180 is mounted to the roller body 160 by the coupling member 170 which surrounds the part of the circumferential surface of the roller body 160 and is coupled with the side surface of the roller body 160, so that the roller body 160 can be formed to have a predetermined thickness thereof while maintaining a predetermined shape and strength thereof.

Figure 2:
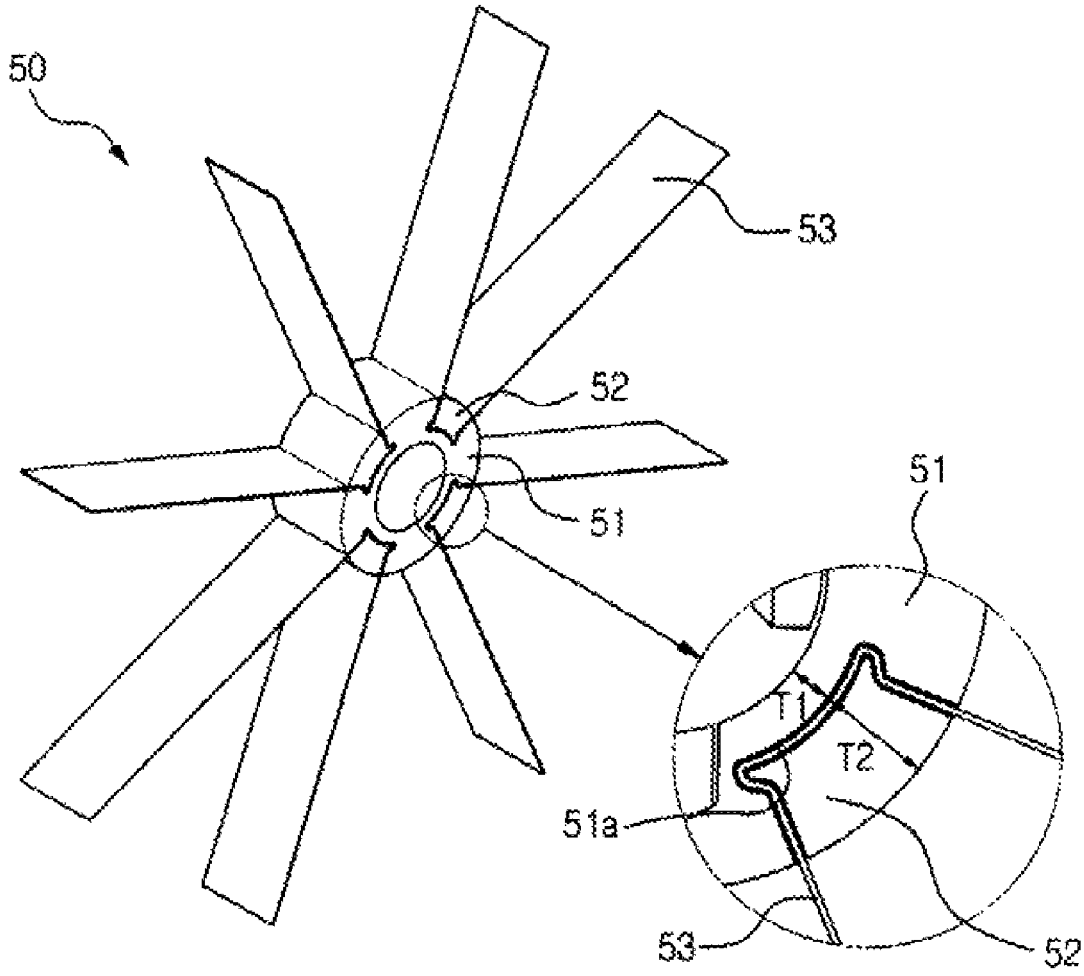
FIG. 2 (CONVENTIONAL ART)
FIG. 2 is a perspective view illustrating a conventional sheet roller.

That is, in the conventional art, in order to form a coupling groove for allowing a coupling member (see the coupling piece 52 of FIG. 2) to be slidingly coupled with the coupling groove while a roller body is being maintained with a predetermined shape and strength, the roller body is required to be formed having a minimum predetermined thickness. However, according to the present exemplary embodiment of the invention, the roller body 160 may be formed to have a minimum thickness to maintain the shape and the strength. As a result, an automatic transaction machine where the sheet roller 160 of the present exemplary embodiment of the invention is mounted has improved space usability and design freedom, and prevents the sheet roller 160 from being interfered with by peripheral components adjacent to the roller body 50.

In addition, according to the present exemplary embodiment of the invention, the elastic sheet 180 is stably contacted closely to and supported by the receiving groove 161 and the coupling member 170 regardless of the thickness of the elastic sheet 180, and even elastic sheets having different thicknesses are easily mounted to the roller body without separately fabricating a roller body and a coupling member corresponding to the different thicknesses of the elastic sheet.

Figure 10:
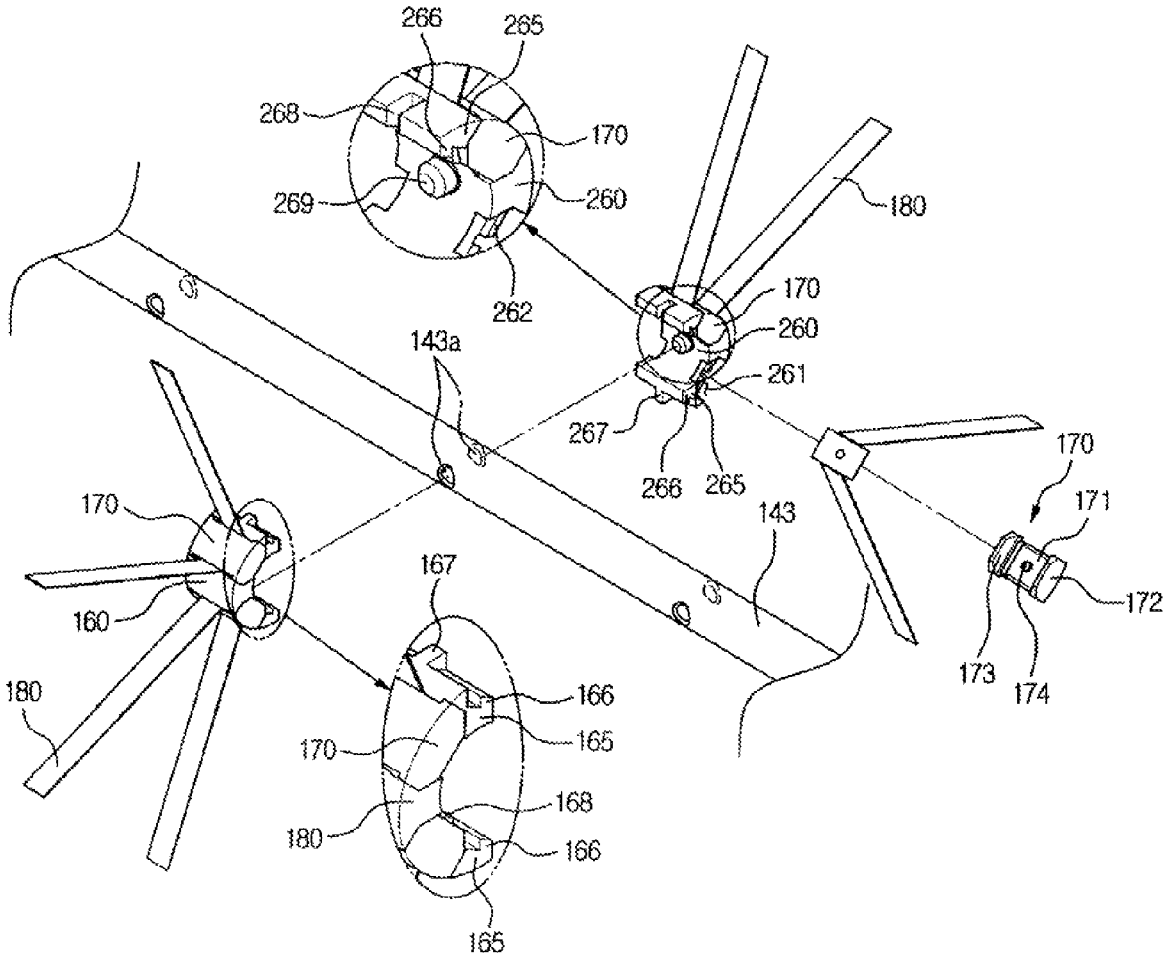
FIGS. 10 and 11 are a perspective view and a side view, respectively, illustrating a structure of a sheet roller according to another exemplary embodiment of the present invention.
Figure 11:
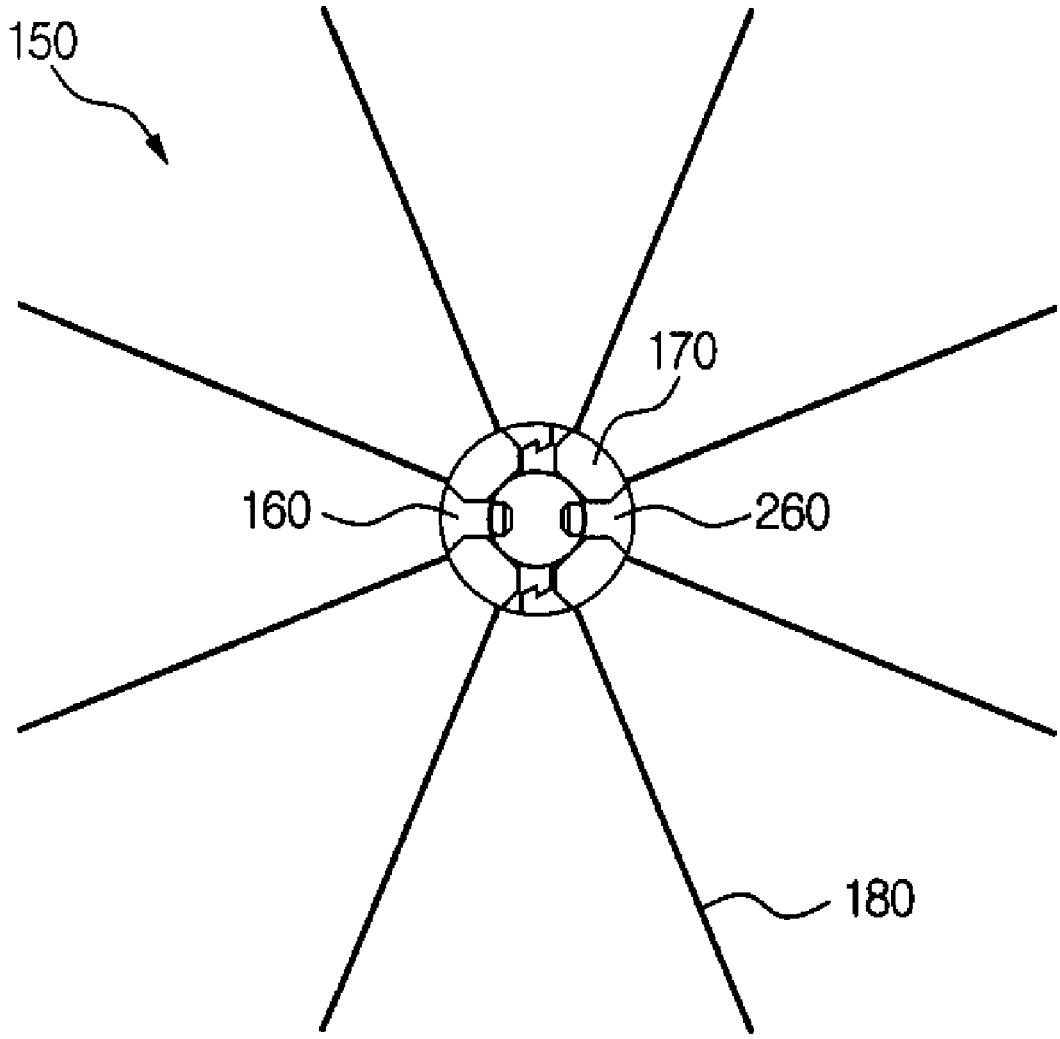
Figure 12:
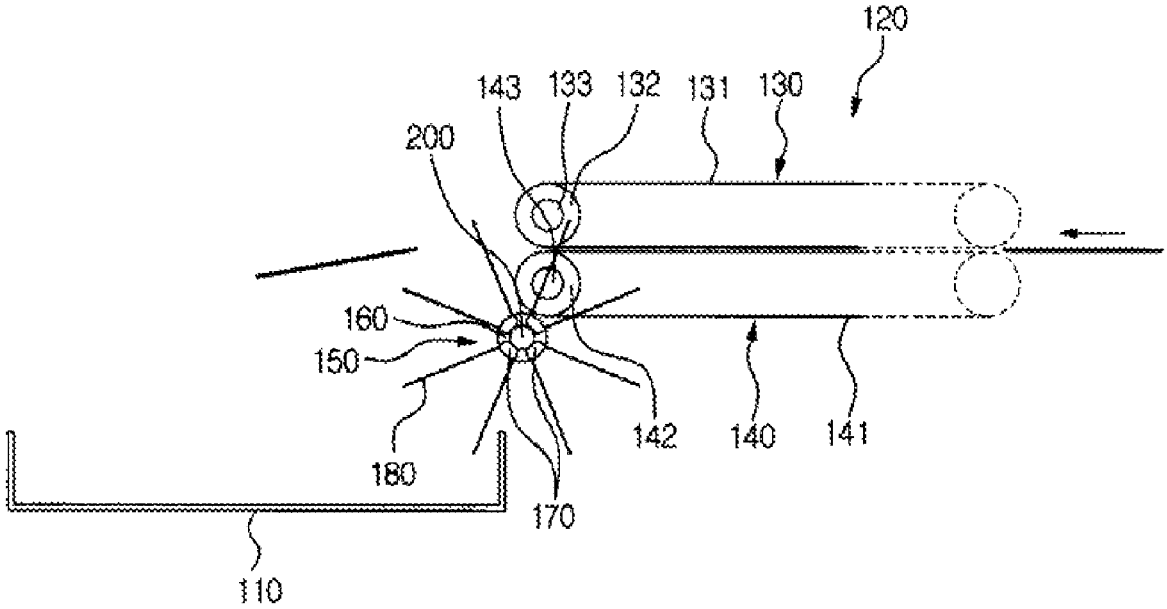
FIG. 12 is a side view illustrating a structure of a sheet roller according to still another exemplary embodiment of the present invention.

FIGS. 10 and 11 are a perspective view and a side view, respectively, illustrating a structure of a sheet roller according to another exemplary embodiment of the present invention, and FIG. 12 is a side view illustrating a structure of a sheet roller according to still another exemplary embodiment of the present invention. The same reference numerals denote the same elements and parts as those in the above embodiment, and thus a detailed explanation thereof will be omitted.

As illustrated in FIGS. 10 and 11, the sheet roller according to the present exemplary embodiment of the invention includes a first roller body 160 coupled with the rotation shaft 143, a second roller body 260 mutually assembled with the first roller body 160 interposing the rotation shaft 143, a plurality of coupling members 170 coupled with respective side surfaces of the first and the second roller bodies 160 and 260 in order to surround a part of respective outer peripheral surfaces of the first and the second roller bodies 160 and 260 and disposed on the respective outer peripheral surfaces of the first and the second roller bodies 160 and 260 in such a manner as to be spaced apart from one another; and an elastic sheet 180 interposed between the respective roller bodies and each of the plurality of coupling members 170.

According to the present exemplary embodiment of the invention, an example where the sheet roller 150 includes the first and the second roller bodies 160 and 260 mutually assembled interposing the rotation shaft 143 is described here, however, depending upon embodiments, the sheet roller 150 may include at least three roller bodies, and the respective roller bodies may be formed in a predetermined circular arc and then assembled to be formed in a ring shape as a whole, so that respective ends of the respective roller bodies are successively connected with one another.

The first roller body 160 is formed in a hollow semicircular shape in its cross-section, and mounted to the rotation shaft 143 of the lower transfer section 140 adjacent to the outlet end of the transfer device 120. The second roller body 260 is formed in a hollow semicircular shape in its cross-section to correspond to the first roller body 160, and is assembled with the first roller body 160 interposing the rotation shaft 143 so as to have a ring shape as a whole. Also, the respective roller bodies 160 and 260 include a plurality of receiving grooves 261 formed thereon, respectively, in such a manner as to be spaced apart from one another along a circumferential direction of the rotation shaft 143.

The first and the second roller bodies 160 and 260 include first and second latching pieces 165 and 265 formed on contact surfaces of the first and the second roller bodies 160 and 260, respectively, so as to be elastically coupled with each other, so that the first and the second roller bodies 160 and 260 can be mutually assembled. In this instance, the first and the second latching pieces 165 and 265 have first and second latching protrusions 166 and 266, respectively.

That is, the first latching piece 165 is integrally formed on both ends of the first roller body 160 opposing to the second roller body 260, respectively, in such a manner as to be elastically moved along a radial direction of the first roller body 160, and the first latching protrusion 166 is integrally formed on an end portion of each of the first latching piece 165 in such a manner as to be disposed to be oriented towards the same direction, respectively. Also, the second latching piece 265 is integrally formed on both ends of the second roller body 260 opposing the first roller body 160, respectively, in such a manner as to be elastically moved along a radial direction of the second roller body 160, and the second latching protrusion 266 is integrally formed on an end portion of each of the second latching piece 265 in such a manner as to be disposed to be oriented towards the same direction, respectively.

Here, the first and the second roller bodies 160 and 260 may be formed in the same manner so that the first and the second latching protrusions 166 and 266 are disposed to be oriented towards the same direction. When performing assembly, the first and the second latching protrusions 166 of the first and the second roller bodies 160 and 260 are opposed to each other. As a result, the first and the second roller bodies 160 and 260 are mutually restricted by the respective latching protrusions 166 and 266, thereby being prevented from being separated from each other along a radial direction of the respective roller bodies 160 and 260.

In this manner, the first and the second roller bodies 160 and 260 are used with the same shape without separately fabricating respective roller bodies, respectively. As a result, when a user assembles the sheet roller 150 described above, the user rotates only either the first roller body 160 or the second roller body 260 formed in the same shape so as to be assembled with each other, without separately separating the first and the second roller bodies 160 and 260, respectively.

According to the present exemplary embodiment of the invention, an example where the first and the second roller bodies 160 and 260 are formed in the same shape, however, they may be formed in a different shape from each other as necessary. Specifically, each of the first latching protrusion of the first roller body may be disposed to be oriented towards opposite directions from each other, respectively, and each of the second latching protrusion of the second roller body may be disposed to be oriented towards opposite directions from the respective first latching protrusion of the first roller body, respectively. In the configuration described above, the first and the second latching protrusions of the first and the second roller bodies may be coupled with each other in a female-male coupling manner.

Also, according to the present exemplary embodiment of the invention, as example where the first and the second roller bodies are assembled with each other by the first and the second latching pieces 165 and 265, which are elastically coupled with each other, having the first and the second latching protrusions 166 and 266, respectively, however, when necessary, a sliding protrusion may be formed on any one of opposite surfaces of the first and the second roller bodies, and a sliding protrusion may be formed on another one of the opposite surfaces of the first and the second roller bodies so that the first and the second roller bodies are slidingly assembled along the axial direction of the rotation shaft of the sheet roller. In addition, the respective roller bodies are fixed by a separate coupling element such as a coupling screw, and the like, after being assembled with each other.

Also, separation prevention protrusions 167 and 267 are formed on a surface of mutual contact surfaces of the first and the second roller bodies 160 and 260, and separation prevention grooves 168 and 268 are formed on another surface of mutual contact surfaces of the first and the second roller bodies 160 and 260. In this instance, the separation prevention protrusions 167 and 267 are received on the separation prevention grooves 168 and 268, respectively. As a result, the first and the second roller bodies 160 and 260 are mutually restricted by the separation prevention protrusions 167 and 267 and the separation prevention grooves 168 and 268, and thereby prevented from being separated from each other along the axial direction of the rotation shaft 143.

Also, the sheet roller 150 is required to be mounted to be prevented from being relatively rotated with the rotation shaft 143. For this purpose, rotation restriction protrusions 269 are formed on an inner peripheral surface of respective inner peripheral surfaces of the first and the second roller bodies 160 and 260, and rotation restriction grooves 143*a* are formed on an outer peripheral surface of the rotation shaft 143, respectively, so that the rotation restriction protrusions 269 are received on the rotation restriction grooves 143*a*. However, the rotation restriction protrusion 269 may be formed either on the first roller body 160 or the second roller body 260 as necessary.

According to the present exemplary embodiment of the invention, an example where the relative rotation of the sheet roller 150 with respect to the rotation shaft 143 is prevented by the rotation restriction protrusion 269 and the rotation restriction groove 143*a* is described here, however, as necessary, a coupling hole having a non-circular shaped-rotation restriction surface may be formed on the inner peripheral surface of the sheet roller so as to correspond to a rotation restriction surface of the rotation shaft 143, so that the relative rotation of the sheet roller to the rotation shaft 143 is prevented. Here, the non-circular shaped-rotation restriction surface denotes a surface capable of being in surface-contact with each other and being prevented from the relative rotation. As an example, a portion of the rotation shaft 143 where the sheet roller is mounted may be processed by a D-cut method, and a D-shaped coupling hole may be formed on the inner peripheral surface of the sheet roller so as to correspond to the D-cut portion of the rotation shaft.

Also, the coupling member 170 is formed in a U-shape, and includes a cover portion 171 formed to surround a part of the outer circumferential surface of the respective roller bodies 160 and 260 and received on the receiving groove 261, and a pair of coupling pieces 172 integrally formed on both ends of the cover portion 171 and coupled with the side surface of the respective roller bodies 160 and 260.

The pair of coupling piece 172 is formed on the cover portion 171 in order to be elastically coupled with the respective roller bodies 160 and 260. For this purpose, the coupling piece 172 includes a coupling protrusion 173 formed on an inner surface of an end portion of the coupling piece 172, and the respective roller bodies 160 and 260 include a fastening step 262 formed on the side surface of the respective roller bodies 160 and 260, respectively, for allowing the coupling protrusion 173 to be fastened to the fastening step 262. In this manner, the coupling member 170 and the respective roller bodies 160 and 260 are mutually restricted by the coupling protrusion 173 and the fastening step 262 coupled together to be opposed to each other, so that the coupling member 170 and the respective roller bodies 160 and 260 are prevented from being separated from each other along radial directions of the respective roller bodies 160 and 260.

The elastic sheet 180 is interposed between the coupling member 170 and the receiving groove, and radially disposed on the outer circumferential surface of the respective roller bodies 160 and 260 in the circumferential direction of the respective roller bodies 160 and 260 in such a manner as to be spaced apart from one another by a predetermined interval. Specifically, a middle portion of the elastic sheet 180 is interposed and fixed between the coupling member 170 and the respective roller bodies 160 and 260, and the elastic sheet 180 is divided into two elastic sheets 180 by the coupling member 170 with a predetermined length, and both free ends of the elastic sheet 180 are disposed in such a manner as to be radially and outwardly extended from the respective roller bodies 160 and 260 in different directions from each other.

The elastic sheet 180 described above abuts against the paper medium in such a manner as to be elastically transformed while the sheet roller 150 is being rotated, and is preferably made of a material having a minimum predetermined friction coefficient in order to draw the paper medium. As an example, the elastic sheet 180 may be made of synthetic resin such as polyamide and the like.

In addition, the elastic sheet 180 may include a sheet extension portion 181 formed on the elastic sheet 180, so that the elastic sheet 180 can be stably disposed on the coupling member 170 without moving. Specifically, the sheet extension portion 181 is integrally extended from both free ends of the elastic sheet 180 so as to have a width corresponding to an interval between the pair of the coupling pieces 172 and supported by the pair of coupling pieces 172, so that the elastic sheet 180 can be stably disposed on the coupling member 170. Accordingly, when the elastic sheet 180 and the coupling member 170 are coupled with the respective roller bodies 160 and 260, respectively, the elastic sheet 180 is coupled with the respective roller bodies 160 and 260 together with the coupling member 170 in the state where the elastic sheet 180 is disposed on the coupling member 170.

Also, the coupling member 170 includes the sheet fixing protrusion 174 formed on the inner surface of the cover portion 171 of the coupling member 170, and the elastic sheet 180 includes the sheet fixing hole 182 formed to correspond the sheet fixing protrusion 174, so that the sheet fixing protrusion 174 is inserted into the sheet fixing hole 182. The sheet fixing protrusion 174 and the sheet fixing hole 182 described above function to allow the elastic sheet 180 to be fixed and disposed between the respective roller bodies 160 and 260 and the coupling member 170.

Further, the respective roller bodies 160 and 260 may include the protrusion receiving groove (see the protrusion receiving groove 163 of FIG. 7) formed on a bottom surface of the receiving groove 261 formed on the respective roller bodies 160 and 260, so that at least a part of the sheet fixing protrusion 174 can be received on the protrusion receiving groove. As a result, the sheet fixing protrusion 174 passing through the elastic sheet 180 is selectively received on the protrusion receiving groove according to a thickness of the elastic sheet 180. Specifically, in a configuration described above, when a relatively thin elastic sheet 180 is used, the sheet fixing protrusion 174 passes through the sheet fixing hole 182 and is received on the protrusion receiving groove, and conversely, when a relatively thick elastic sheet 180 is used, the sheet fixing protrusion 174 is merely received on an inside of the sheet fixing hole 182, so that the elastic sheet 180 can be stably contacted closely to and supported by the receiving groove and the coupling member 170 regardless of the thickness of the elastic sheet 180.

The elastic sheet 180 is divided into two elastic sheets with a predetermined length by the coupling member 170 and the both free ends of the elastic sheet 180 are radially disposed from the respective roller bodies 160 and 260. The respective roller bodies 160 and 260 and the coupling member 170 include the first and the second inclined guide surfaces (see first and second inclined guide surfaces 164 and 175 of FIGS. 7 and 8) formed on the respective roller bodies 160 and 260 and the coupling member 170, respectively, in such a manner as to be opposed to each other so that the both free ends of the elastic sheet 180 are disposed inclined at a predetermined angle with each other. Specifically, the first and the second inclined guide surfaces having their gradients corresponding to each other are formed on both side surfaces of the cover portion 171 and both side surfaces of the receiving groove 161 corresponding to the both side surfaces of the cover portion 171, respectively, along the axial direction of the rotation shaft 143. The elastic sheet 180 is guided by the first and the second inclined guide surfaces and the both free ends of the elastic sheet 180 are extendedly disposed inclined at a predetermined angle.

As described above, according to the present invention, the elastic sheet may be mounted to the roller body by the coupling member coupled with the side surface of the roller body in such a manner as to surround a part of the circumferential surface of the roller body, so that the roller body is formed to have a predetermined thickness while maintaining a predetermined shape and strength of the roller body, and thus, improving space usability and design freedom of an automatic transaction machine where the sheet roller is mounted, and preventing the roller body from being interfered with by peripheral components adjacent to the roller body.

Also, according to the present invention, the elastic sheet may be stably contacted closely to and supported by the receiving groove and the coupling member regardless of the thickness of the elastic sheet, so that even elastic sheets having different thicknesses are readily mounted.

According to the present invention, the sheet roller may include a plurality of roller bodies so as to be assembled with one another around the rotation shaft, so that the sheet roller is readily mounted on the appropriate position regardless of the order of assembly with other components.

In particular, according to the present invention, the sheet roller may be mounted on a desired position regardless of the cases where both ends of the rotation shaft is already fixed, and other components such as a roller is already mounted to the rotation shaft.

In addition, according to the present invention, when the sheet roller is replaced, only the sheet roller may be separated from the rotation shaft so as to be replaced with a new sheet roller without separation/disassembly of the rotation shaft and separation of different components having been mounted to the rotation shaft.

Also, according to exemplary embodiments of the invention as described above, an example where the sheet roller 150 is mounted to a rotation shaft 143 of the lower transfer section 140 constituting the transfer device 120 is described here, however, depending upon embodiments, as illustrated in FIG. 12, the sheet roller may be mounted through a separate rotation shaft 200 mounted to be adjacent to the outlet end of the transfer 120 separately with the transfer device 120. The rotation shaft 200 described above may be operated while the transfer device 120 is being operated, and rotated by the same driving source as that of the transfer device 120 or a separate driving source.

As described above, according to the present invention, the sheet roller may be formed to be relatively thin, while maintaining the predetermined shape and the strength, and thus, improving space usability and design freedom of an automatic transaction machine where the sheet roller is mounted, and preventing the roller body from being interfered with by peripheral components adjacent to the roller body.

Also, according to the present invention, even elastic sheets having different thicknesses may be readily mounted to the roller body without separately fabricating a roller body and a coupling member corresponding to the different thicknesses of the elastic sheet.

Also, according to the present invention, the sheet roller may improve productivity and workability thereof.

In particular, according to the present invention, the sheet roller may be mounted on a required position regardless of the cases where both ends of the rotation shaft are already fixed, and other components such as a roller is already mounted to the rotation shaft.

Also, according to the present invention, the sheet roller may facilitate maintenance and repair thereof without separation/disassemble of other components. Specifically, when performing maintenance or repair of the sheet roller, only the sheet roller may be separated from the rotation shaft so as to be replaced with a new sheet roller without separation/disassembly of the rotation shaft and separation of different components having been mounted to the rotation shaft.

Although a few exemplary embodiments of the present invention have been shown and described, the present invention is not limited to the described exemplary embodiments. Instead, it would be appreciated by those skilled in the art that changes may be made to these exemplary embodiments without departing from the principles and spirit of the invention, the scope of which is defined by the claims and their equivalents.

What is claimed is:

1. A sheet roller which is mounted to a rotation shaft adjacent to an outlet end of a paper medium transfer device, the sheet roller comprising:

a roller body coupled with the rotation shaft;

a plurality of coupling members coupled with a side surface of the roller body in order to surround a part of an outer peripheral surface of the roller body, and disposed on the outer peripheral surface of the roller body in such a manner as to be spaced apart from one another; and a plurality of elastic sheets, each elastic sheet being interposed between the roller body and one of the plurality of coupling members, wherein each of the plurality of coupling members includes a cover portion formed to surround a part of the outer peripheral surface of the roller body, and a pair of coupling pieces integrally formed on both ends of the cover portion and coupled with the side surface of the roller body.

2. The sheet roller of claim 1, wherein each of the pair of coupling pieces is formed on the cover portion in order to be elastically coupled with the roller body, and includes a coupling protrusion formed on an inner surface of the coupling piece, wherein the roller body includes a fastening step formed on the side surface of the roller body for allowing the coupling protrusion to be fastened to the fastening step.

3. The sheet roller of claim 1, wherein the elastic sheet includes a sheet extension portion supported between the pair of coupling pieces, wherein the sheet extension portion is extendedly formed to have a width corresponding to an interval between the pair of the coupling pieces.

4. The sheet roller of claim 1, wherein the roller body includes a plurality of receiving grooves formed on the roller body, each receiving groove allowing one of the plurality of elastic sheets and one of the plurality of coupling members to be received on the receiving groove.

5. The sheet roller of claim 1, wherein a middle portion of one elastic sheet is fixed to the roller body together with one coupling member, and both free ends of the one elastic sheet are radially disposed about the roller body.

6. The sheet roller of claim 5, wherein the roller body includes a first inclined guide surface formed on the roller body, and the one coupling member includes a second inclined guide surface formed on the one coupling member in such a manner as to be opposed to the first inclined guide surface.

7. The sheet roller of claim 1, wherein one coupling member includes a sheet fixing protrusion formed on the one coupling member, and one elastic sheet includes a sheet fixing hole formed on the one elastic sheet for allowing the sheet fixing protrusion to be fixed and inserted into the sheet fixing hole.

8. The sheet roller of claim 7, wherein the roller body includes a protrusion receiving groove formed on the roller body for allowing the sheet fixing protrusion to be received on the protrusion receiving groove.

* * * * *

UNITED STATES PATENT AND TRADEMARK OFFICE

CERTIFICATE OF CORRECTION

PATENT NO. : 7,871,069 B2
APPLICATION NO. : 11/771302
DATED : January 18, 2011
INVENTOR(S) : Dong Sik Lee It is certified that error appears in the above-identified patent and that said Letters Patent is hereby corrected as shown below:

Title page, item (75), Inventors:, second line, delete "Joon" and insert -- Joong --, therefor.

Signed and Sealed this
Twenty-second Day of November, 2011

David J. Kappos

David J. Kappos
*Director of the United States Patent and Trademark Office*